US009157141B2

(12) United States Patent
Marya et al.

(10) Patent No.: US 9,157,141 B2
(45) Date of Patent: Oct. 13, 2015

(54) CONDITIONING FERROUS ALLOYS INTO CRACKING SUSCEPTIBLE AND FRAGMENTABLE ELEMENTS FOR USE IN A WELL

(75) Inventors: Manuel Marya, Pearland, TX (US); Andrew T. Werner, East Bernard, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1256 days.

(21) Appl. No.: 11/844,414

(22) Filed: Aug. 24, 2007

(65) Prior Publication Data

US 2009/0050334 A1 Feb. 26, 2009

(51) Int. Cl.

| | |
|---|---|
| ***C21D 9/08*** | (2006.01) |
| ***C21D 8/10*** | (2006.01) |
| ***C25D 11/00*** | (2006.01) |
| ***C25D 9/00*** | (2006.01) |
| ***C25D 7/00*** | (2006.01) |
| ***C23C 14/34*** | (2006.01) |
| ***C21D 6/04*** | (2006.01) |
| ***B32B 15/01*** | (2006.01) |
| ***E21B 29/00*** | (2006.01) |
| ***C23C 8/02*** | (2006.01) |
| ***C23C 8/00*** | (2006.01) |
| ***E21B 41/00*** | (2006.01) |
| *E21B 34/00* | (2006.01) |

(52) U.S. Cl.

CPC ... *C23C 8/02* (2013.01); *C23C 8/00* (2013.01); *E21B 41/00* (2013.01); *E21B 2034/005* (2013.01)

(58) Field of Classification Search

None

See application file for complete search history.

(56) References Cited

U.S. PATENT DOCUMENTS

| | | | | |
|---|---|---|---|---|
| 3,102,419 | A * | 9/1963 | Schaschl | 73/86 |
| 4,369,078 | A | 1/1983 | Aslund | |
| 4,655,852 | A | 4/1987 | Rallis | |
| 4,970,783 | A * | 11/1990 | Olaniran et al. | 29/888.09 |
| 5,165,478 | A * | 11/1992 | Wilson | 166/297 |
| 5,952,056 | A | 9/1999 | Jordan et al. | |
| 6,413,326 | B1 | 7/2002 | Rallis | |
| 7,208,052 | B2 | 4/2007 | Hammond et al. | |
| 2005/0150653 | A1* | 7/2005 | Hall et al. | 166/178 |
| 2007/0107908 | A1 | 5/2007 | Vaidya et al. | |
| 2007/0181224 | A1 | 8/2007 | Marya et al. | |

FOREIGN PATENT DOCUMENTS

| | | | |
|---|---|---|---|
| GB | 2435046 | A | 8/2007 |
| RU | 2083689 | C1 | 7/1997 |

(Continued)

OTHER PUBLICATIONS

Russian Federation Office Action issued in 2008134583 on Jul. 12, 2012, 8 pages.

(Continued)

*Primary Examiner* — Yoshitoshi Takeuchi

(74) *Attorney, Agent, or Firm* — Jeffery R. Peterson; Brandon Clark

(57) ABSTRACT

A technique includes providing a tool to be deployed in a well to perform a downhole function. The downhole function requires a minimum structural integrity for an element of the tool. The technique includes forming at least part of the element from a ferrous alloy and charging the alloy with hydrogen cause the element to be more prone to cracking than before the hydrogen charging.

12 Claims, 10 Drawing Sheets

(56) References Cited

FOREIGN PATENT DOCUMENTS

| | | | |
|---|---|---|---|
| RU | 20083689 | C1 | 7/1997 |
| RU | 2148697 | C1 | 5/2000 |
| RU | 2148697 | C1 | 5/2002 |
| RU | 2227201 | C2 | 4/2004 |
| RU | 20031366088 | A | 5/2005 |
| SU | 853088 | A | 8/1981 |
| SU | 1521857 | A1 | 11/1989 |
| SU | 1692779 | A1 | 11/1991 |
| WO | 2001027344 | A1 | 4/2001 |
| WO | 2005118904 | A2 | 12/2005 |

OTHER PUBLICATIONS

Russian Decision on Grant for Application No. 2008134583/03 dated Oct. 1, 2012.

* cited by examiner

CONDITIONING FERROUS ALLOYS INTO CRACKING SUSCEPTIBLE AND FRAGMENTABLE ELEMENTS FOR USE IN A WELL

BACKGROUND

The invention relates generally to oilfield exploration, production and testing, and more specifically to the conditioning of ferrous alloy elements (tools and equipments and components thereof) into cracking susceptible and fragmentable elements for use downhole in a well.

In the upstream oil and gas industry, the deployment and running of tools and equipments downhole (i.e., down a well, and part of this well may be horizontal) involves considerable time and operating costs. Furthermore, when these tools and equipments are no longer useful to the hydrocarbon exploration, production, or well testing, their retrievals from the wells introduce additional workover time, expenses, and risks (for instance, the improper retrieval of a tool may result in damages to the well completion, itself having well productivity). From a well operator's standpoint, simplifying the well operation by omitting an equipment recovery (fishing) operation offer a cost saving, in addition to technical, safety, and reliability advantages.

In the development of wells for hydrocarbon production, there are tools and equipments, and likewise components of tools and equipments, that are only needed and utilized once, after which they are obsolete and therefore invaluable. An example of fairly large tool falling in the defined category is a perforating gun. A perforating gun is a long tubular product, carrying explosive charges, that is lowered downhole for purposes of penetrating via detonation of these charges and the formation of supersonic jets one or more formations and enable and/or assist in the release of its hydrocarbons. Other examples of downhole tools useful only once are check valves for control or safety devices. Check valves are important elements of well completions because they permit fluids to flow, or pressure to act, in one direction only. A popular type of spring-loaded check valve used today in numerous well completions is the flapper valve. In some instances, flappers include rupture disks that are specifically designed to fracture into harmless fragments at set pressure differential. Other examples of downhole tools that are valuable only once are plugs, and other restrictors, for flow-control and/or zone isolation. Those include bridge plugs and, more generally, may include any other temporary plug (sometimes called dart) set to isolate two distinct parts of a wellbore. In operating a well, it may become extremely desirable to leave a tool or an equipment downhole once it has fulfilled its designated function and reach life time. However, with current tools and well workover practices, there are enormous risks that abandoning tools in the well will interfere with subsequent production and/or intervention operations. On the contrary, having downhole tools and equipments, and likewise components of downhole tools and equipments that predictably break into small and harmless fragments, and optionally disappear over time due to corrosion, will prevent such tool retrieving (fishing) operations and will therefore offer new technical and economical advantages in addition to greater safety and reliability on the rig floor.

SUMMARY

In an embodiment of the invention, a technique includes providing a tool to be deployed in a well to perform a downhole function. The downhole function requires a minimum structural integrity for an element of the tool. The technique includes forming at least part of the element from a ferrous alloy and charging the alloy with hydrogen to cause the element to be more prone to cracking than before the hydrogen charging.

In another embodiment of the invention, a technique that is usable with a well includes providing a template to define an etching pattern. The technique includes establishing contact between the template and a downhole element and causing the element to be cathodic and the downhole element to be anodic to etch the downhole element according to the pattern to predispose the downhole element to fracturing.

In yet another embodiment of the invention, an apparatus that is usable with a well includes an element that is adapted to be deployed in the well and has first and second materials. The first and second materials are adapted to form galvanic cells from debris that is formed from the disintegration of the element downhole in the well.

Advantages and other features of the invention will become apparent from the upcoming drawings, descriptions and claims.

DETAILED DESCRIPTION

Figure 1:
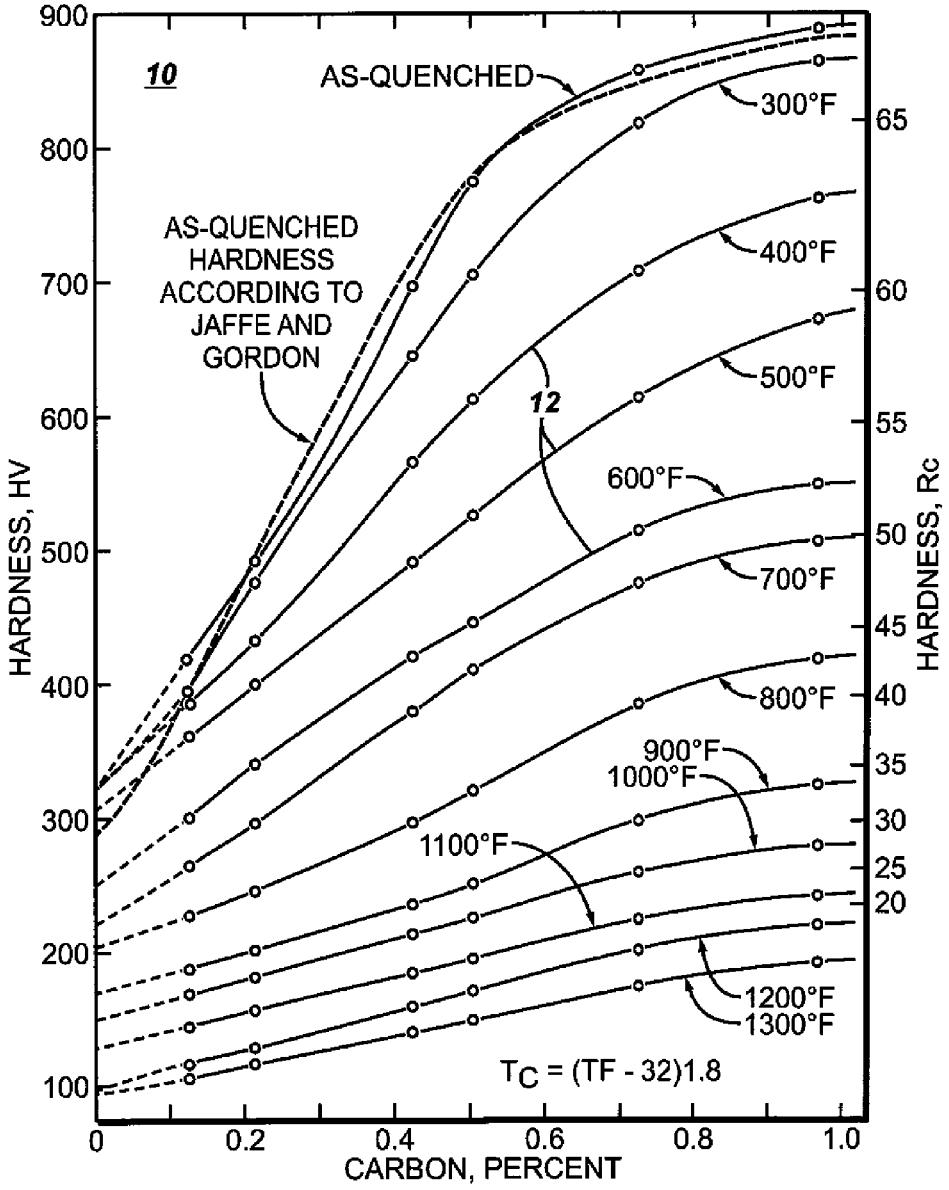
FIG. 1 is a graphical representation applying to low carbon and carbon steels (ferrous alloys with carbon as main alloying element and carbon percentage is limited to about 1) depicting their hardness (Vickers hardness, HV) as a function of their carbon content for metallurgical conditions such as as-quenched (Q), and quenched and tempered (Q&T) at various temperatures.

In accordance with embodiments of the invention, an economical solution to safely abandon a tool downhole uses commercially available ferrous alloys and make them susceptible to cracking and fragmenting in the presence of an applied force (pressure, stress) field and hydrogen in the ferrous alloy. Exactly like "fighting fire with fire" and in a counter-intuitive way, the embodiments of the invention that are set forth herein enhance the systematically-avoided or bothersome natural degradation that occurs in a downhole environment in order to rapidly disappear an element that is no longer needed to complete or operate the well. The debris that results from fragmenting the element falls to the well floor, corrodes (degrades) over time, and is harmless to the operation of the well. The materials described in accordance with embodiments of the invention are susceptible to hydrogen embrittlement and galvanic corrosion under proper environmental conditions. As examples, the materials may be low-alloyed steels, cast irons, martensitic stainless steels (including 410-13Cr type, 17-4 PH type steels). However, other materials may alternatively be used, as long as the material is predominantly ferrous (as in containing iron up to about 50 percent by weight for instance) or includes ferrous components, as found for instance in a composite material. Other examples of stainless alloys that may used with conditioning techniques in accordance with embodiments of the invention are austenitic alloys such as A286; an alloy that may contain as much as 25 weight percent chromium and 15 weight percent nickel, and is therefore fully austenitic and consequently less prone to cracking and more expensive than other cited ferrous alloys. Also included among ferrous alloys that may be used in accordance with embodiments of the invention are duplex stainless steels (25Cr-type). Like austenitic steels, duplex stainless steel will be less susceptible to hydrogen embrittlement, and like other stainless steels, and their debris will corrode (degrade) less than non-stainless ferrous alloys (e.g. carbon steels).

In accordance with embodiments of the invention described herein, a downhole well element may be formed at least in part from a high-strength ferrous alloy, which is predisposed to fracture after the element has performed its intended downhole function in the presence of an applied force (pressure) field, permanent (static load) or transient (e.g. impact or explosion). In some embodiments, the disintegration originates from an increase in applied force (pressure, stress), as might be induced by injecting fluids and enabling a pressure buildup, dropping a gravity-driven object to cause an impact, or a detonation from an explosive charge, or other jets. These techniques of triggering fracture on the downhole elements may be used for temporary plugs, flapper valves or perforating guns for instance. In certain situations, no external intervention is used but instead the downhole element is designed to fracture over time because of the conditioning applied to the ferrous alloy of this element.

A technique described herein for purposes of predisposing a particular downhole element for fracturing involves mechanisms of cold cracking by hydrogen embrittlement. In normal situations, this type of damage is systematically avoided, as it remains one of the most feared type of failures during service in the field. Cold cracking refers to delayed cracking, usually at ambient or at low temperatures (i.e. comparable to well temperatures) and necessitates, without order of preference, all of the following: (1) tensile stresses, (2) an inherently susceptible microstructure (such as a martensitic microstructure), and (3) the presence of hydrogen (i.e. atomic hydrogen in the ferrous microstructure). A technique in accordance with an embodiment of the invention utilizes mechanisms of cold cracking by hydrogen ingress for purposes of fracturing a large element into fragments so that this large element may consequently be left permanently in the well. A technique in accordance with embodiments of the invention thus uses hydrogen embrittlement to force a strong and reliable element to fracture at lower strength level shortly after being hydrogen charged and therefore embrittled. In one example, applying to a flow control device, a flapper disk made of high strength ferrous alloy is used to hold pressure. Some point in time, when the flapper needs to permanently release pressure, this flapper is charged with hydrogen in-situ the well via the use for instance of an electrical source (cathodic charging). As hydrogen predictably diffuses and accumulates over time in the high-strength ferrous alloy of the flapper element (note: the hydrogen buildup in the ferrous alloys preferably occurs along internal boundary, as further described later), the flapper disk weakens and predictably fails at a much lower strength than would have been needed without the hydrogen charging (in fact, without hydrogen, the flapper would not have failed). The results of causing the flapper to break (fragment) under a hydrostatic pressure is the release of a flow.

Ferrous alloys such as carbon steels and cast irons are some of the most inexpensive structural materials; they are readily available and may be processed in a variety of useful shapes that make them attractive for oilfield applications. Of these materials are ferrous alloys such as the hypereutectoid steels (i.e., iron-carbon alloys having a carbon percent by weight of more than 0.77 percent, such as 1095 grade steel, for example) and in general, low-alloyed steels having more than 0.5 weight percent carbon. These alloys offer immense advantages for downhole elements such as perforating guns, temporary plugs, as non-limiting examples. These alloys are inexpensive, processable, and they exhibit sufficient strength for downhole usage over a short time. Other ferrous alloys that may be used in accordance with embodiments of the invention include stainless steels such as 410-13Cr type, 17-4 PH type, austenitic A286-type, or duplex alloys such as 25Cr-type alloys. These materials, in the conditioned state described herein, may not be used for permanent tools. However, when properly conditioned (in accordance with industry standards), these materials may be applied to permanent downhole tools depending upon factors such as well conditions and usage of corrosion inhibitors, among others.

FIG. 1 contains an illustration 10 of the hardness as a function of the carbon content for carbon steels. The steels are either as-quenched and thus martensitic or as-quenched and tempered and thus having some tempered martensite. FIG. 1 shows that their hardness typically increases with their percentage of carbon, as indicated by the hardness versus carbon curves 12 for different tempering temperatures. When such ferrous alloys are inadvertently subject to hydrogen embrittlement conditions during service, a brittle and intergranular type fracture eventually occur at engineering stresses well below the alloy normal yield strength. In the presence of a force (pressure, stress) field comprising tensile components, crack nucleation and growth will occur depending upon extents of the force (pressure, stress) components and level of hydrogen ingress (i.e. amount of hydrogen diffused) in the ferrous alloy.

Combined with proper mechanical design, such as notches and stress risers at the surface of the element, the hydrogen embrittlement may be preferentially concentrated near these notches and stress risers to force. As a result, fracture in the element may predictably occur at these desired locations of greater stresses. The development of predictable fracture paths, thru mechanical design, may optionally be used in numerous downhole tools, or parts of tools, to help form small and harmless fragments from a large element. Examples of such tools are discussed further below.

Figure 2:
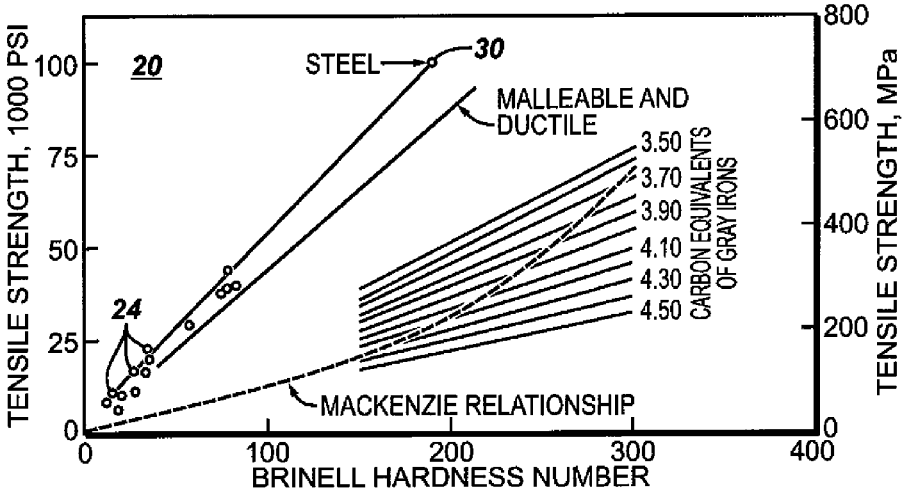
FIG. 2 is a graphical representation describing the tensile strength of cast irons (ferrous alloys with over about 2 weight percent carbon) as a function of their hardness and carbon equivalents.
Figure 3:
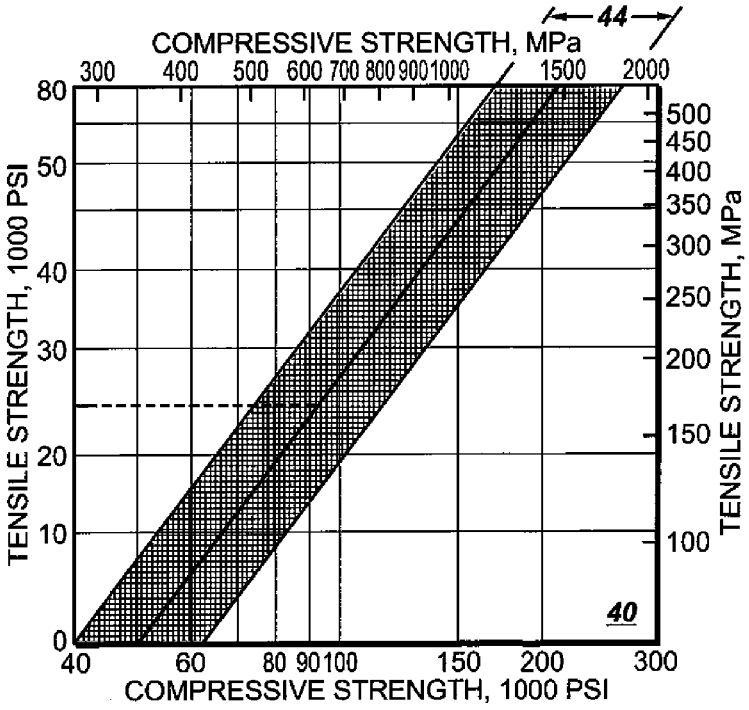
FIG. 3 is a graphical representation showing a linear relationship between tensile strength and compressive strength for cast irons.

In addition to being particularly inexpensive, cast irons and in particular, gray cast irons have graphitic microstructures that lack toughness and thus also facilitate the desired fracturing. Similar to iron-carbon steels, the tensile strengths of the cast irons increase with their hardness, but decrease with cast iron carbon content or carbon equivalent number, as depicted in FIG. 2. In this regard, FIG. 2 depicts an illustration of tensile strength versus hardness for various cast irons, at points 24 and steel at point 30. As depicted in FIG. 2, a gray cast iron with a carbon content of about 4.5 percent by weight may exhibit a tensile strength as low as 25 kilopounds per square inch (ksi). It is noted, however, that the compressive strength of the cast iron may be relatively high. For example, FIG. 3 depicts an illustration 40 of tensile strength versus compressive strength for cast irons. As illustrated by the estimated relationship 44, the same 25 ksi tensile strength for the cast iron with a carbon content of 4.5 percent by weight possesses a significantly greater compressive strength, estimated to be in the vicinity of 90 ksi. For downhole applications, where resistance to high collapse pressure is primary and where compressive strength is of primary importance, a cast iron material having a carbon content of 4.5 percent by weight for instance may be sufficient if the material encounters primarily compressive forces (pressure, stress), or is designed to fracture under an applied force (pressure, stress) field. Compared to steels, cast irons open a new range of mechanical properties, which combined with the inventive alloy conditioning techniques creates new downhole applications.

Both steels and cast irons are susceptible to hydrogen cracking. If substantial austenite (as normally not found in grey cast iron, or austenitic cast irons) is present, greater hydrogen charging will be needed to cause the alloy to fracture, as simplistically explained by the austenite greater toughness and greater hydrogen solubility (but lower hydrogen diffusivity). Examples of brittle phases that would promote hydrogen cracking in ferrous alloys are martensite, ferrite, bainite, carbides such as cementite, and graphite (graphite is found in cast iron). Ferrous alloys that include large percentage of these phases inherently possess high quasi-static strengths along with a low toughness (high brittleness), in particular under loading conditions that produce high strain rates (such as impacts, for example). It should be noted that embodiments of the invention are not restricted to iron-carbon alloys and include all ferrous alloys with the proviso the alloy is susceptible to hydrogen-induced cracking with or without the proposed methods of hydrogen charging once placed in a wellbore environments. Other attractive examples of ferrous alloys that may be used in accordance with embodiments of the invention are low-alloy steels, martensitic stainless steels, precipitation-strengthened (PH) martensitic steels, such as those containing chromium as main alloying addition (e.g. 13Cr-type, 17-4PH type alloys), and duplex stainless steels (e.g. 25Cr-type). Despite higher costs, greater corrosion resistance, and a tendency toward becoming more austenitic, ferrous alloys including nickel, molybdenum, and nitrogen may also be useful to the invention, especially if they are processed to exhibit to microstructure susceptible to hydrogen embrittlement, and exposed to sufficient hydrogen charging.

In addition to brittle phases and the presence of hydrogen in the ferrous alloys, some of the factors that promote a high density of fracture initiation and thus, the formation of fine debris upon application of a force (pressure, stress) field are the following: a directionally-oriented microstructure (a fibrous microstructure, for example); grain-boundary phase inclusions (carbides, oxides, etc.) and allotriomorph; (sulfides, for example, as found in poor-quality steels); fine martensite laths and plates (to produce a high density of interfaces, which provide sites for hydrogen to diffuse and accumulate); absence or minimal concentrations of inclusions within the austenite grains (so as to prevent, for example, for instance the growth of acicular ferrite in some carbon steels); and cold work (i.e., a high dislocation density, subgrains, etc.). In reviewing the factors influencing brittle fracture by hydrogen embrittlement, the presence of a high density of interfaces, as described herein, is a non-negligible factor controlling debris formation.

Figure 4:
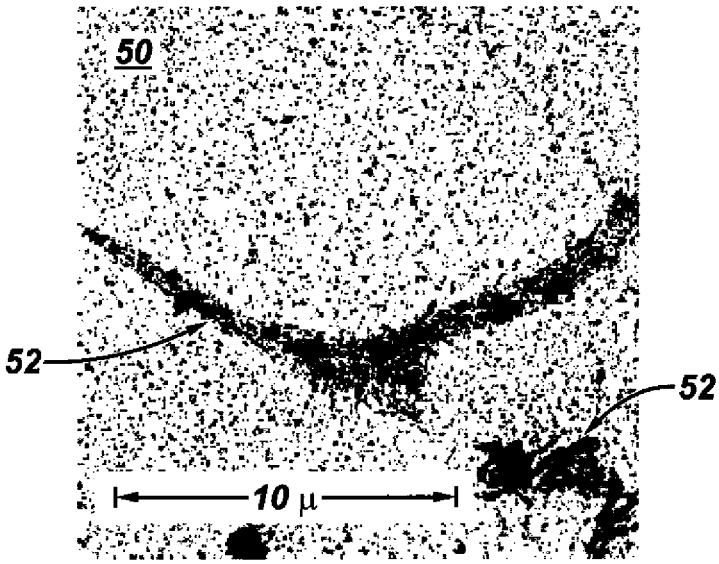
FIG. 4 depicts an optical micrograph illustrating hydrogen cracking associated with a pearlite microstructure in an iron-carbon steel.
Figure 5:
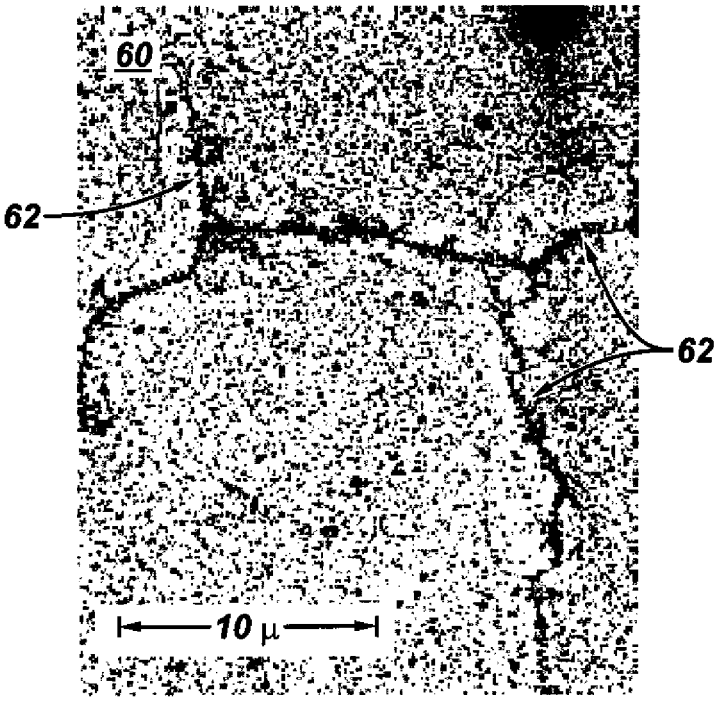
FIG. 5 depicts an optical micrograph illustrating hydrogen cracking associated with a cementite microstructure in an iron-carbon steel.

As an example of cracking along grain boundaries (i.e., transgranular fractures) in a microstructure that is particularly prone to hydrogen cracking, FIG. 4 depicts an optical micrograph 50 of cracking 52 along grain boundaries in a pearlite (i.e., ferrite and cementite) microstructure for a iron-carbon steel. As another example, FIG. 5 depicts another optical micrograph 60, which illustrates cracking 62 that occurs along grain boundaries in a spherodized carbide (i.e., cementite) microstructure.

In addition to promoting fractures at an equivalent tensile stress lower than the ferrous alloy normal yield strength (i.e. without the hydrogen embrittlement), the presence of atomic hydrogen in the ferrous alloy may enhance corrosion (degradation) in aqueous and ionic environments (includes brines and acid environments). Upon contact with an aqueous fluid, the release of hydrogen cations (H+) from the ferrous alloy, and correspondingly increased concentration in hydronium cations ($H_3O$+) at the surface of an iron-carbon alloy debris contributes to lower the pH within a boundary layer, thereby creating a more acidic and corrosive environment that prevents passivation and therefore enhances corrosion (i.e., degradation) of the debris by gradual mass loss.

Figure 6:
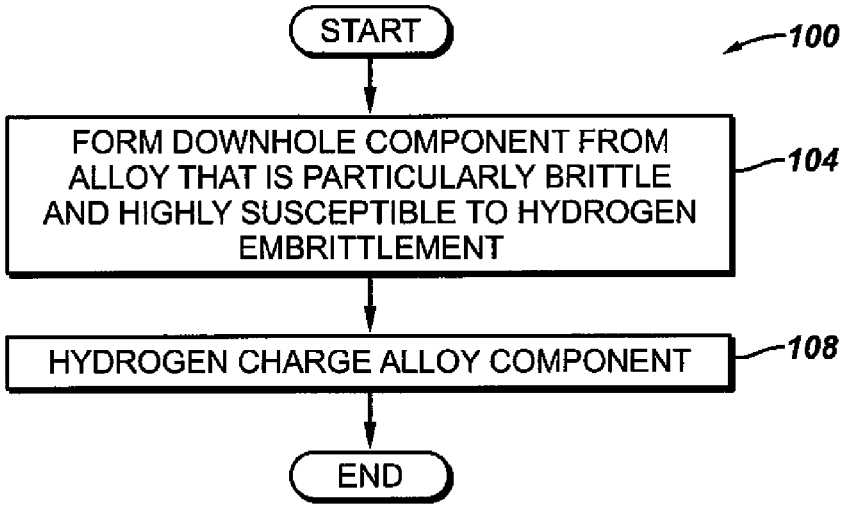
FIG. 6 is a flow chart depicting a technique to induce fractures in a downhole component according to an embodiment of the invention.

Referring to FIG. 6, in accordance with some embodiments of the invention, a downhole element (i.e., one or more parts of a tool or equipment that is constructed to be deployed downhole in a downhole well environment) may be made susceptible to fracturing pursuant to a technique 100. In the technique 100, the downhole element is formed at least partially from a ferrous alloy that is relatively brittle and is highly susceptible to hydrogen embrittlement, pursuant to block 104. The technique 100 includes charging with hydrogen the ferrous alloy, pursuant to block 108. The technique 100 may include additional acts, in accordance with other embodiments of the invention, such as sealing the downhole elements to prevent hydrogen degassing may be needed, if charging is not conducted in-situ the well.

Specific examples of downhole elements made from ferrous alloys include temporary plugs and flapper valves. Prior to deployment downhole, the ferrous alloy is heat-treated to exhibit a microstructure that is susceptible to hydrogen cracking. In one hypothetical example, the heat-treated ferrous alloy may be delivered in its as quenched state. By having an untempered martensite microstructure, this ferrous alloy is most sensitive to hydrogen embrittlement. In another example, considered more practical, the ferrous alloy may be conditioned to be in a quenched and tempered state. In such example, the presence of tempered martensite, and possibly increased percentage of austenite, helps controlling alloy cracking susceptibility, and importantly fully eliminate premature cracking prior to deployment downhole. Ferrous alloys that are martensitic, including precipitation-hardened martensitic steels, and contain approximately 12 to 18 percent by weight chromium (e.g. 410-13Cr-type, 17-4PH type) are today used in quenched and tempered conditions. Such alloys, if hydrogen charged to controllable amounts, will predictably fracture at applied stresses much lower than the alloy normal strength; i.e. hydrogen reduces alloy strength. A downhole element such as a temporary plug or a flapper disk, with at one or several of its surfaces discontinuities such as machined notches may be used to force hydrogen-assisted cracking to develop precisely within those notches, and thus form debris of controllable sizes. In this example, the machined notches are, in the presence of a stress field, stress-risers, and locations of high stresses (tensile) are locations where hydrogen-cracking will preferentially occur.

Figure 7:
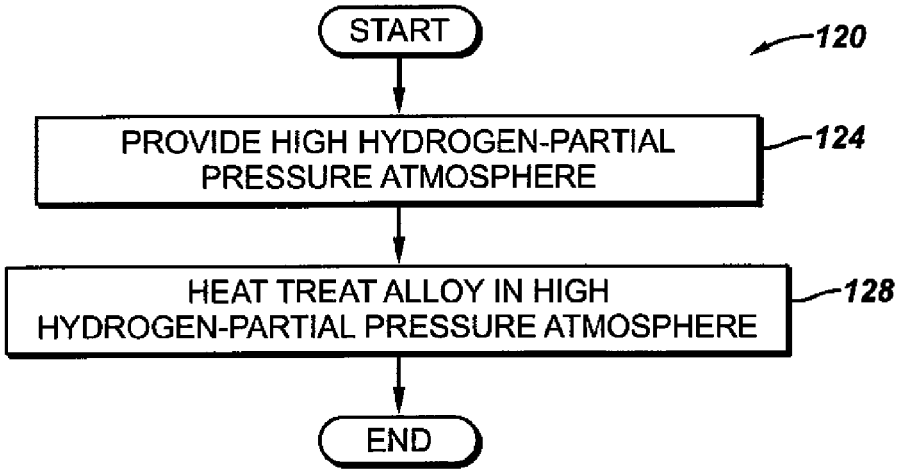
FIGS. 7, 8 and 9 are flow charts depicting different techniques to charge with hydrogen a ferrous alloy that forms at least part of a downhole component according to embodiments of the invention.

Several techniques may be utilized to introduce hydrogen in lattices of ferrous alloys. Some may be more practical than others. For example, referring to FIG. 7, in accordance with some embodiments of the invention, heat treating may be used to charge with hydrogen the ferrous alloy pursuant to a technique 120. In the technique 120, a high hydrogen partial pressure atmosphere is provided pursuant to block 124. This atmosphere may or may not include steam depending on the particular embodiment of the invention, as steam ensures the rapid adsorption and diffusion into the bulk of the ferrous alloy. The ferrous alloy is heat treated in the high hydrogen partial pressure atmosphere, pursuant to block 128. As a more specific example, the heat treating of the ferrous alloy may be performed in a furnace that contains only hydrogen gas (i.e. a situation where partial pressure of hydrogen equals furnace pressure), for example. The technique 120 may be followed by a sealing-off operation to prevent hydrogen degassing. Heat-treating to hydrogen charge the ferrous alloy would be conducted prior to deployment downhole, unlike other embodiments of this invention.

Figure 8:
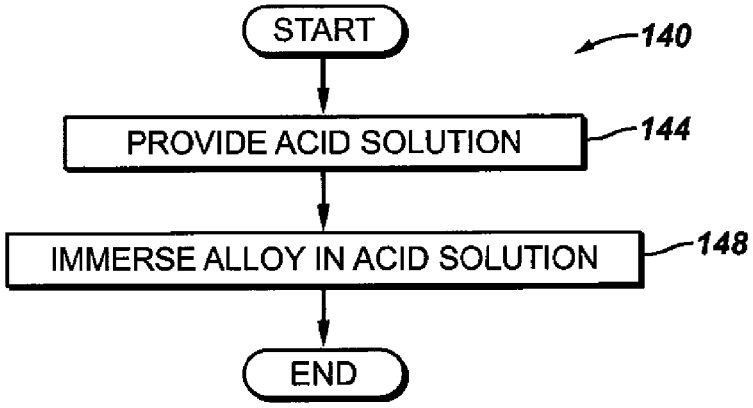

FIG. 8 depicts a technique 140 in which acidizing the ferrous alloy is used for purposes of charging the ferrous alloy with hydrogen. More specifically, pursuant to the technique 140, an acid solution is provided (block 144). The acid is a hydronium-rich (H+) solution, strong enough to guarantee charging, but also relatively benign to prevent dissolution of the ferrous alloy. The ferrous alloy is immersed in the acid solution, pursuant to block 148. The effectiveness of the technique 120 depends on such factors as the acid solution composition, temperature, concentration as well as the presence or not of adherent corrosion products on the ferrous alloy. The technique 120 may follow a sealing-off operation to minimize hydrogen degassing unless the hydrogen charging is conducted in the well; in such a case, if acidic conditions exists or are established in the well environment (for instance by pumping acids down), some hydrogen charging will occur in the ferrous alloy. In accordance with embodiments of the invention, intentional hydrogen charging is used in acid wells for purposes of abandoning a downhole element.

Figure 9:
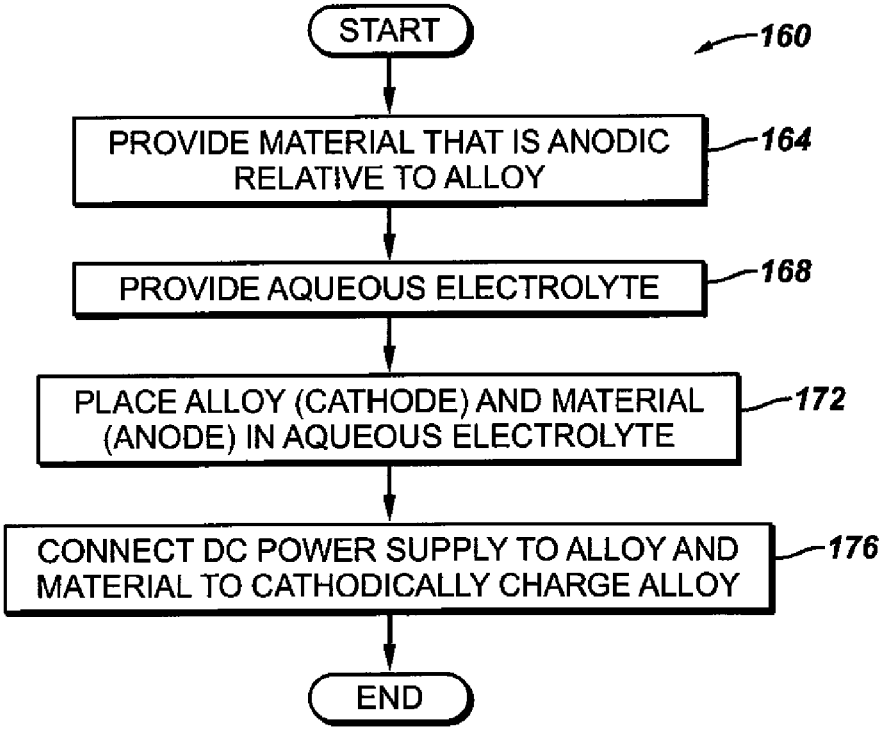

Cathodic charging is a very effective method to introduce hydrogen and promote cold cracking in a ferrous alloy, pursuant to a technique 160 that is depicted in FIG. 9. According to the technique 160, a material that is anodic relative to the alloy is provided (block 164), along with an electrolyte, or electrically conductive fluid (block 168) that enable for the formation of a galvanic cell. Thus, due to this arrangement, the ferrous alloy is cathodic relative to the anodic material. The ferrous alloy and the anodic material are placed in the electrolyte (aqueous to be susceptible to release hydrogen cations), pursuant to block 172, and a DC power supply is connected (block 176) to the ferrous alloy and material to cathodically charge the ferrous alloy. In this regard, the negative terminal of the power supply is connected to the anodic material and the positive terminal of the power supply is connected to the ferrous alloy, made cathodic. The use of a source of electrical power (via wireline or slickline, as examples) allows faster hydrogen charging of the ferrous alloy.

Thus, at least the three processes that are set forth above may be used to charge the ferrous alloy with hydrogen. It is noted that a combination of these processes may be utilized, in accordance with some embodiments of the invention. For example, in accordance with some embodiments of the invention acidizing and cathodic charging may be combined to force hydrogen in the ferrous alloy.

The cathodic charging may be conducted either prior to downhole deployment of the ferrous alloy (in the downhole element); or alternatively, the cathodic charging may be conducted in-situ, that is in a downhole environment using available conductive and ionic fluid (e.g. water, frac. fluids, diluted acids, brine solutions). It is noted that performing the cathodic charging downhole may present significant economic advantages; one reason being that hydrogen charging prior to downhole deployment may require sealing in which case the hydrogen-embrittled part may be sealed by rapid cooling (possibly to subzero temperatures) before applying a hydrogen-containing barrier as coating. Metallic coating with low hydrogen permeability, such as those made of metals like tin or zinc as opposed to plastics or elastomers may be used after the hydrogen charging has been conducted.

In some embodiments of the invention, the downhole element may be predisposed to fracturing by creating, at designated locations, patterns, or arrays, of notches, grooves, and other discontinuities on a surface of the ferrous alloy. These discontinuities, in turn, predispose the ferrous alloy to fracture at selected locations. For the example of a perforating gun, a pattern of grooves may be created on the inner surface of a tubular shaped charge carrier, for example. The pattern of grooves may be produced by a template, in accordance with some embodiments of the invention. In general, the template is cathodic, whereas the downhole element is made anodic (e.g. via a power supply) and is thus subject of mass loss or removal at preselected locations. For the case in which the downhole element is a perforating gun, the template may be a tubular template, which is placed on the inside of the tubular carrier. After the tubular shaped charge carrier has been subject of selective mass loss, anode and cathode may be switched (via use of a connected power supply) so that the tubular shaped charge carrier is properly charged with hydrogen.

Depending on the particular embodiment of the invention, the template may be consumable, partially consumable, or non-consumable and may be made from a mesh of a material less reactive than the ferrous alloy to be etched (i.e. more anodic); for instance the template may be made of a zinc alloy. The etching on the ferrous alloy of the downhole element is intentionally created such that it contributes in influencing cracking, such a controlling crack growth to yield fine debris, for example. In order to facilitate the formation of fine debris, a template from a fine mesh may be particularly appropriate in accordance with some embodiments of the invention. This fine mesh promotes a higher density of notches over the ferrous alloy surface and consequently aids the formation of finer debris.

Figure 10:
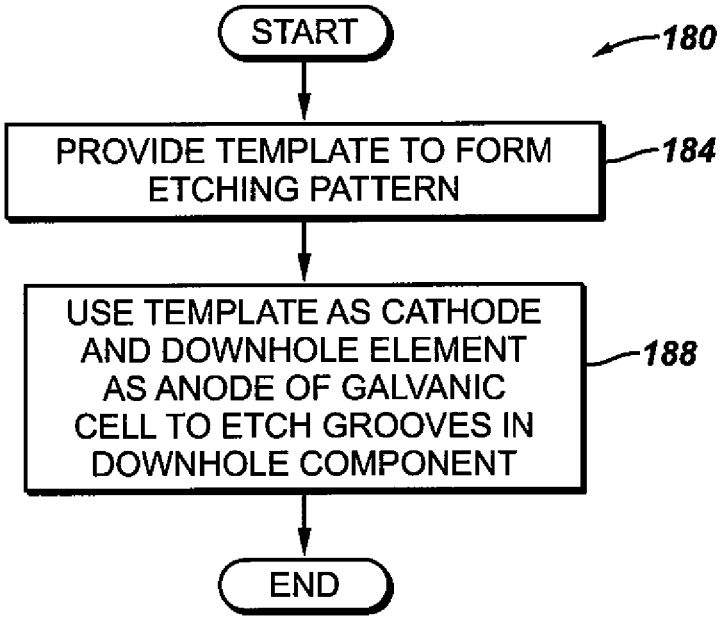
FIG. 10 is a flow chart depicting a technique to use a template to create fracturing-inducing grooves in a downhole component according to an embodiment of the invention.

Thus, referring to FIG. 10, in accordance with some embodiments of the invention, a technique 180 may be used to create fracturing patterns on a downhole element. Pursuant to the technique 180, a template is provided (block 184) to form an etching pattern. The template is then used as a cathode and the downhole element is used as the anode, thus forming a galvanic cell to etch grooves in the downhole element, pursuant to block 188.

The particular surface, or surfaces, on which grooves for instance are formed may be selected to affect only negligibly the overall structural integrity (including pressure rating) of the downhole element for purposes of performing its intended function. For the example in which the downhole element is a perforating gun having a tubular charge carrier, the pressure on the outer surface of the perforating gun will normally exceed that on the inner diameter. Therefore, grooves on the inner surface of the shaped charge carrier have only a small influence on the collapse pressure rating of the carrier (i.e., the perforating gun). In other words, the effect of the grooves that are induced by the template is far less significant with compressive stresses than with tensile stresses of comparable magnitudes.

Figure 27:
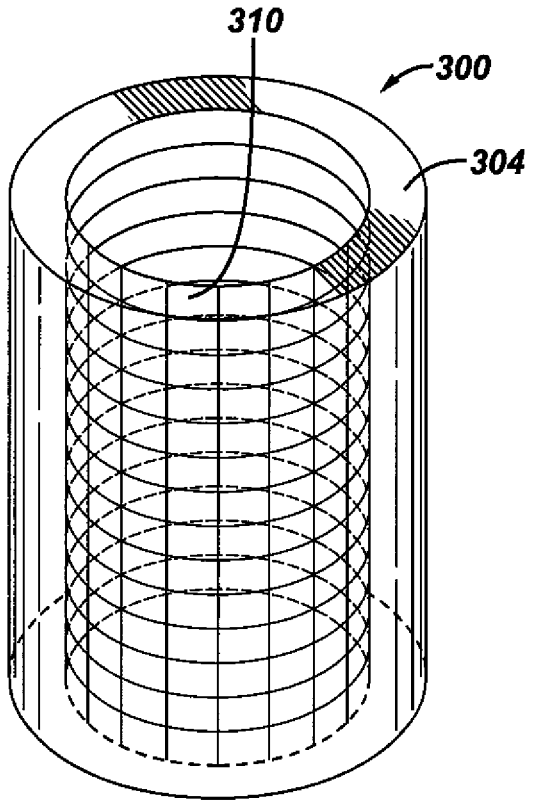
FIG. 27 is a perspective view of a downhole component according to an embodiment of the invention.
Figure 28:
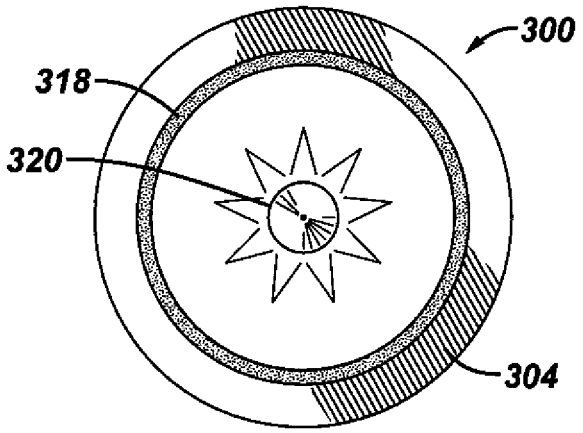
FIG. 28 is a top view of the downhole component of FIG. 27, illustrating the use of a downhole explosion to promote disintegration of the component according to an embodiment of the invention.

FIG. 27 generally depicts the example of a downhole tubular element 300, such as a perforating gun, that has a tubular element 304 that is notched (grooved) on its inner surface by a tubular template 310. As depicted in FIG. 28, as a result of the etching by the template, the downhole element 300 has a notched (grooved) section 318 on its inner surface, which facilitates disintegration of the element 300. As shown in FIG. 28, after the downhole element 300 has reached service life by completing its function, an explosive 320 may be lowered inside the central passageway of the downhole element 300 and detonated (as a non-limiting example) for purposes of producing an explosive force that, in conjunction with the grooved/notched section 318 causes the disintegration of the element 304.

Figure 30:
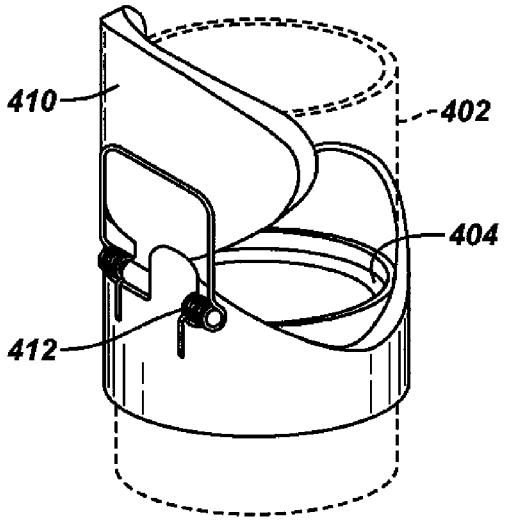
FIG. 30 is a perspective view of a flapper valve according to an embodiment of the invention.

As another example, a flow control device, such as an exemplary flapper valve 400 that is depicted in FIG. 30, may have at least one element that is etched by a template. More specifically, the flapper valve 400 has a tubular body 402 that defines a central passageway and contains a valve seat 404. A flapper disc 410 is pivotably mounted to control fluid communication through the valve seat 404. As depicted in FIG. 30, the flapper disc 410 may be spring-biased to close fluid communication through the valve seat 404.

Figure 31:
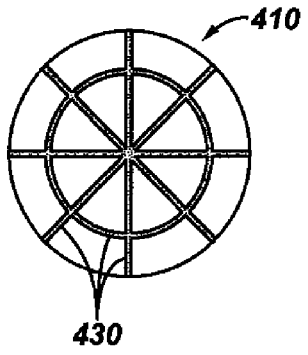
FIG. 31 is a top view of a flapper disc of the flapper valve of FIG. 30 according to an embodiment of the invention.

Referring to FIG. 31 in conjunction with FIG. 30, in accordance with some embodiments of the invention, the above-described etching may be used for form notches (grooves) 430 in the flapper disc 410. Therefore, the flapper valve 400 may have relatively simple design that permits the flapper disc 410 to break (i.e., fragment) under sufficient hydrostatic pressure to effect a flow release.

Figure 11:
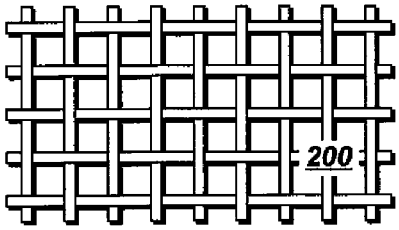
FIGS. 11, 12, 13, 14, 15, 16, 17, 18, 19, 20, 21, 22, 23, 24, 25 and 26 are illustrations of exemplary template patterns according to different embodiments of the invention.
Figure 12:
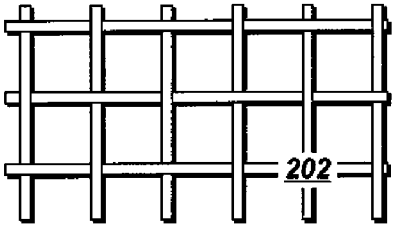
Figure 13:
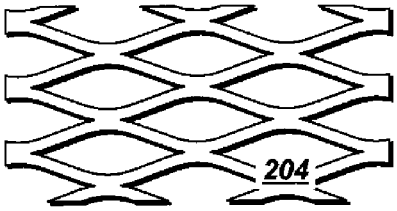
Figure 14:
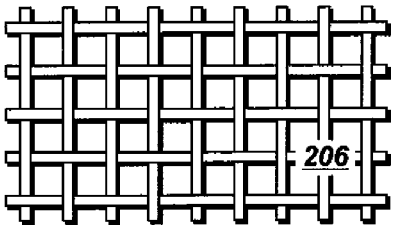
Figure 15:
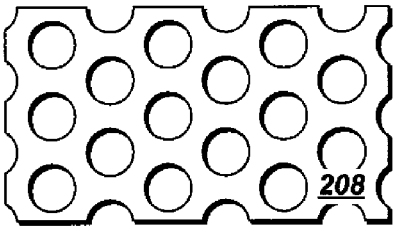
Figure 16:
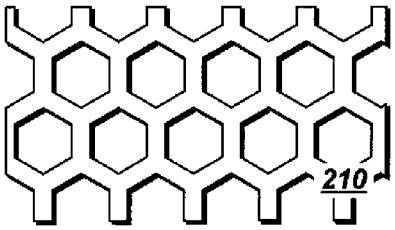
Figure 17:
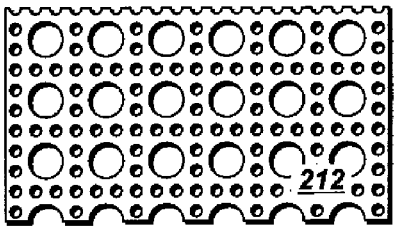
Figure 18:
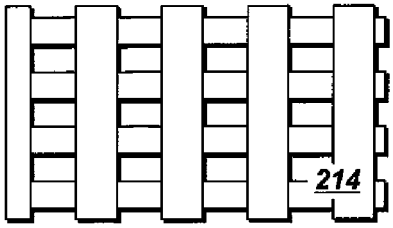
Figure 19:
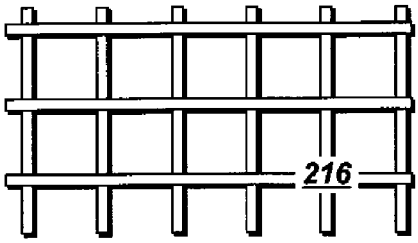
Figure 20:
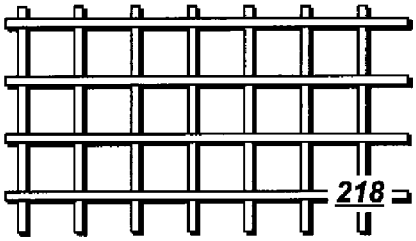
Figure 21:
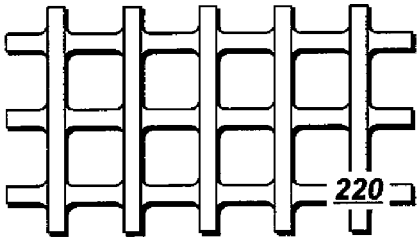
Figure 22:
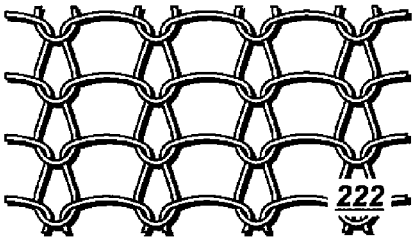
Figure 23:
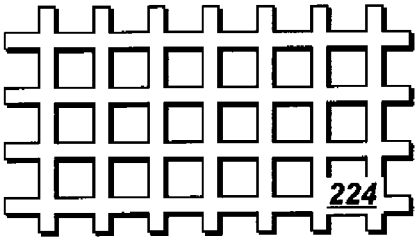
Figure 24:
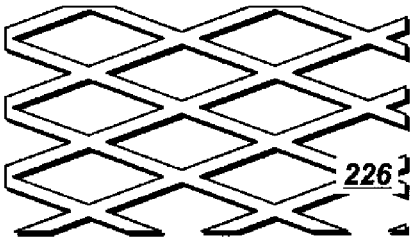
Figure 25:
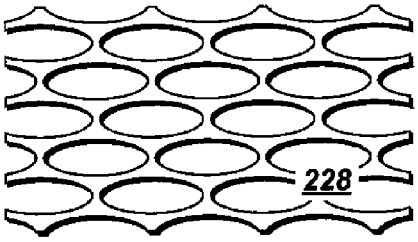
Figure 26:
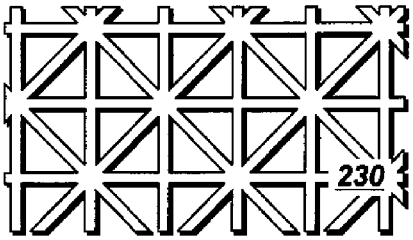

The template may take on numerous forms, depending on the particular embodiment of the invention. As examples of possible embodiments of the invention, the template, made of galvanically active material, may be a woven wire cloth 200 (FIG. 11); a crimped wire cloth 202 (FIG. 12); an expanded metal sheet 204 (FIG. 13); a woven wire mesh 206 (FIG. 14); a round hole perforated sheet 208 (FIG. 15); a hexagonal hole perforated sheet 210 (FIG. 16); a cane perforated sheet 212 (FIG. 17); an interweave perforated sheet 214 (FIG. 18); a welded wire cloth 216 (FIG. 19); an electroformed wire cloth 218 (FIG. 20); a molded metallic mesh 220 (FIG. 21); a knitted mesh 222 (FIG. 22); a square perforated sheet 224 (FIG. 23); a diamond perforated sheet 226 (FIG. 24); an oval perforated sheet 228 (FIG. 25); or a union jack perforated sheet 230 (FIG. 26).

In other embodiments of the invention, a material may be adhered to the downhole element for purposes of creating intra-galvanic cells, which are active after the downhole element has fragmented in debris. This material, which may be a coating that entirely or partially covers one or several particular surfaces of the element, may originate from the template, for embodiments, for example, where the template includes zinc as a non-limiting example. In this example, the template may be a consumable material. The presence of a zinc coating, or layer, for instance on a hydrogen-charged element can help enhance the degradation of the formed debris. Thus, for the case of a perforating gun, for example, the template that is located on the inner diameter of the perforating gun may be made from a material, such as zinc that forms an anode of the created galvanic cells when the charge case is disintegrated.

Figure 29:
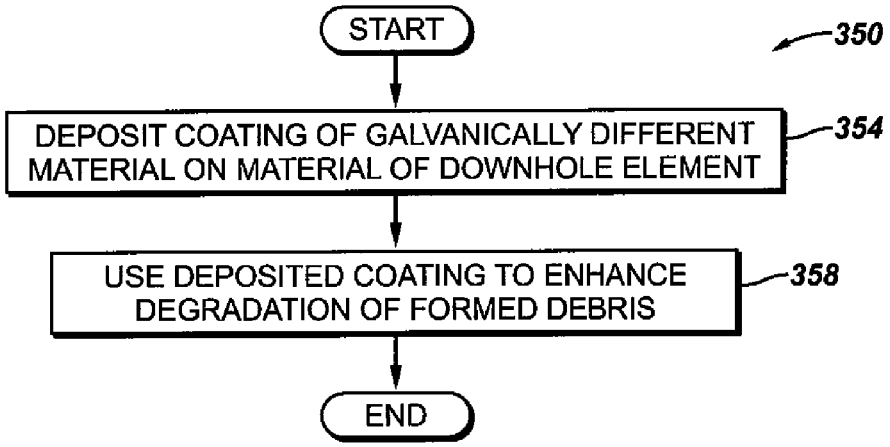
FIG. 29 is a flow chart describing a technique to enhance the degradation of downhole debris according to an embodiment of the invention.

To summarize, FIG. 29 depicts a technique 350, which includes depositing a coating of galvanically different material on the material of a downhole element, pursuant to block 354. In stark contact with coatings that typically are used in the oil and gas industry, the deposited coating is used (block 358) to enhance the degradation of formed debris and is applied downhole.

Other variations are contemplated and are within the scope of the appended claims. For example, the depositing of materials to create galvanic cells may be combined with the technique of charging the ferrous alloy with hydrogen. With such a combination, as an example, the hydrogen embrittlement will be greatest at the valleys (deepest portions) of the grooves, thus promoting a well control fracturing upon application of an impact.

Other embodiments are within the scope of the appended claims. For example, a perforating gun has been used throughout the foregoing description for purposes of illustrating one example of a downhole element that is made susceptible to cracking. However, the techniques that are described herein may be applied to other downhole elements, such as flow control devices and valves, packers (as a non-limiting example). More particular, a plug or other element used in connection with a temporary valve may be predisposed in accordance with embodiments of the invention to fracture or erode after the object has reached service life by completing its intended downhole function. Thus, many variations are contemplated, all of which are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

providing a tool to be deployed in a well to perform a downhole function, the downhole function requiring a minimum structural integrity for an element of the tool;

forming at least part of the element from a ferrous alloy;

charging the alloy with hydrogen to cause the element to be more prone to cracking than before the hydrogen charging;

sealing the charged portion of the downhole element to prevent hydrogen loss; and placing the downhole element having a sealed charged portion in a wellbore environment.

2. The method of claim 1, further comprising:

performing the downhole function; and after performance of the downhole function, impacting the element to fracture the element.

3. The method of claim 1, further comprising:

conditioning the ferrous alloy prior to deployment of the element downhole in the well to cause the ferrous alloy to exhibit a microstructure susceptible to hydrogen-induced cracking.

4. The method of claim 1, wherein the act of hydrogen charging comprises:

conditioning the ferrous alloy through heat treating in an atmosphere sufficiently enriched in hydrogen to charge the ferrous alloy with hydrogen; and immersing the ferrous alloy in an acid; and/or cathodically charging the ferrous alloy.

5. A method comprising:

providing a tool to be deployed in a well to perform a downhole function, the downhole function requiring a minimum structural integrity for an element of the tool;

positioning the tool within a well;

performing the downhole function with the tool;

charging a ferrous alloy portion of the tool positioned within the well with hydrogen to cause the ferrous alloy portion of the tool to be more prone to cracking than before the hydrogen charging; and fracturing the tool along the charged ferrous alloy portion.

6. The method of claim 1, wherein the act of hydrogen charging the ferrous alloy comprises:

cathodically charging the downhole element before deploying the element downhole in the well.

7. The method of claim 1, wherein the sealing comprises forming a coating of a zinc, tin, and/or other low melting temperature metal on the alloy after the charging.

8. The method of claim 1, wherein the tool comprises a valve.

9. The method of claim 5, wherein the act of hydrogen charging the ferrous alloy comprises:

cathodically charging the alloy downhole in the well.

10. The method of claim 9, wherein fracturing the tool occurs as a result of wellbore pressure.

11. The method of claim 9, wherein fracturing the tool includes dropping a gravity driven object onto the tool.

12. The method of claim 9, wherein fracturing the tool includes detonation an explosive.

* * * * *